US005964541A

United States Patent [19]

Murison et al.

[11] Patent Number: 5,964,541

[45] Date of Patent: Oct. 12, 1999

[54] THERMAL PRINTER APPARATUS

[75] Inventors: Alexander S. Murison; Gary R. Marshall, both of Waterloo, Canada

[73] Assignee: NCR Corporation, Dayton, Ohio

[21] Appl. No.: 09/123,692

[22] Filed: Jul. 28, 1998

[51] Int. Cl.[6] ..... B41J 3/60

[52] U.S. Cl. ..... 400/188; 400/58; 400/59; 101/93.41; 101/93.42

[58] Field of Search ..... 347/220; 400/58, 400/59, 264, 188, 613.1, 128.21, 128.4; 101/287–291, 316, 93–94

[56] References Cited

U.S. PATENT DOCUMENTS

| | | | |
|---|---|---|---|
| 3,810,192 | 5/1974 | Okabe . | |
| 4,560,292 | 12/1985 | Takahashi . | |
| 4,815,871 | 3/1989 | McGourty et al. | 400/120 |
| 4,818,126 | 4/1989 | Brooks et al. . | |
| 4,952,084 | 8/1990 | Maruyama | 400/120 |
| 5,071,266 | 12/1991 | Harada et al. . | |
| 5,118,208 | 6/1992 | Kitahara et al. . | |
| 5,137,378 | 8/1992 | Satoh . | |
| 5,265,966 | 11/1993 | Schmidt . | |
| 5,445,460 | 8/1995 | Nakajima . | |
| 5,555,009 | 9/1996 | Hevenor et al. | 347/198 |

*Primary Examiner*—Edgar Burr
*Assistant Examiner*—Charles H. Nolan, Jr.
*Attorney, Agent, or Firm*—Michael Chan

[57] ABSTRACT

A sheet to be printed on can be transported along a sheet feed path to a printing position. The sheet feed path extends along a first direction. A thermal print head is located on one side of the sheet feed path and is provided for printing onto a sheet which has been transported to the printing position along the sheet feed path. A print platen is located on an opposite side of the sheet feed path and is provided for printing onto a sheet which has been transported to the printing position along the sheet feed path. A spring mechanism is provided for biasing the head and the platen towards each other to contact the sides of a sheet in the printing position to allow printing on the sheet in the printing position. A drive mechanism is provided for moving the head and the platen in a second direction which is transverse to the first direction to allow printing on a sheet in the printing position to occur while the head and the platen are contacting the sheet in the printing position. A cam mechanism is provided for moving the head and the platen away from each other to move the head and the platen out of contact with a sheet in the printing position after printing on the sheet in the printing position has occurred. The drive mechanism and the cam mechanism cooperate to move the head and the platen back to their initial positions when the head and the platen are moved away from each other and out of contact with a sheet in the printing position to allow another printing to occur.

4 Claims, 5 Drawing Sheets

THERMAL PRINTER APPARATUS

BACKGROUND OF THE INVENTION

The present invention relates to thermal printers, and is particular directed to a thermal printer apparatus including a thermal print head and a print platen movable relative to each other.

A typical known thermal printer includes a print platen which does not move towards and away from the plane of a sheet being printed on. The thermal printer further includes a thermal print head which is movable towards and away from the print platen and also movable up and down relative to the print platen. Initially, a sheet feeder transports a sheet to be printed on to a printing position along a sheet feed path. When the sheet is at the printing position, the print head is controlled to move into contact with one side of the sheet. The print platen is usually already in contact with the opposite side of the sheet. When the print platen and the print head are contacting the sides of the sheet, thermal elements on the print head are controlled in a known manner to print information onto the sheet.

After printing information onto the sheet, the print head is moved away from the one side of the sheet. The sheet feeder then transports the sheet to a different position before the print head moves back into contact with the one side of the sheet to print other information onto the sheet. This cycle is repeated until all desired information is printed onto the sheet. After all desired information is printed onto the sheet, the sheet feeder transports that sheet out of the printing position. A disadvantage in using known print platens and print heads to print information onto sheets moving along the sheet feed path is that print quality may not always be consistent, especially when the sheet feeder feeds sheets into and out of the printing position along the sheet feed path at a relatively high rate.

SUMMARY OF THE INVENTION

In accordance with one aspect of the present invention, a thermal printer apparatus comprises a sheet feeder for transporting a sheet to a printing position along a sheet feed path extending along a first direction. A thermal print head is located on one side of the sheet in the printing position. A print platen is located on an opposite side of the sheet in the printing position. Moving means is provided for (i) moving the head and the platen from initial positions towards each other to contact the sides of the sheet in the printing position to allow printing on the sheet in the printing position, (ii) moving the head and the platen in a second direction which is transverse to the first direction to allow printing on the sheet in the printing position to occur while the head and the platen are contacting the sheet in the printing position, (iii) moving the head and the platen away from each other to move the head and the platen out of contact with the sides of the sheet in the printing position after printing on the sheet in the printing position has occurred, and (iv) moving the head and the platen back to their initial positions when the head and the platen are moved away from each other and out of contact with the sides of the sheet in the printing position to allow another printing to occur.

Preferably, the moving means includes (i) a first arm to which the head is connected, (ii) a second arm to which the platen is connected, and (iii) a spring mechanism interconnecting the first and second arms and biasing the first and second arms towards each other and thereby biasing the head and the platen towards each other. The moving means includes a cam positioned between the first and second arms, the cam having cam surfaces which spread the first and second arms apart against the biasing force of the spring mechanism when the cam surfaces are in a predetermined position.

In accordance with another aspect of the present invention, a thermal printer apparatus comprises means defining a sheet feed path along which a sheet to be printed on can be transported to a printing position. The sheet feed path extends along a first direction. A thermal print head is located on one side of the sheet feed path and is provided for printing onto a sheet which has been transported to the printing position along the sheet feed path. A print platen is located on an opposite side of the sheet feed path and is provided for printing onto a sheet which has been transported to the printing position along the sheet feed path. A spring mechanism is provided for biasing the head and the platen towards each other to contact the sides of a sheet in the printing position to allow printing on the sheet in the printing position. A drive mechanism is provided for moving the head and the platen in a second direction which is transverse to the first direction to allow printing on a sheet in the printing position to occur while the head and the platen are contacting the sheet in the printing position. A cam mechanism is provided for moving the head and the platen away from each other to move the head and the platen out of contact with a sheet in the printing position after printing on the sheet in the printing position has occurred. The drive mechanism and the cam mechanism cooperate to move the head and the platen back to their initial positions when the head and the platen are moved away from each other and out of contact with a sheet in the printing position to allow another printing to occur.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
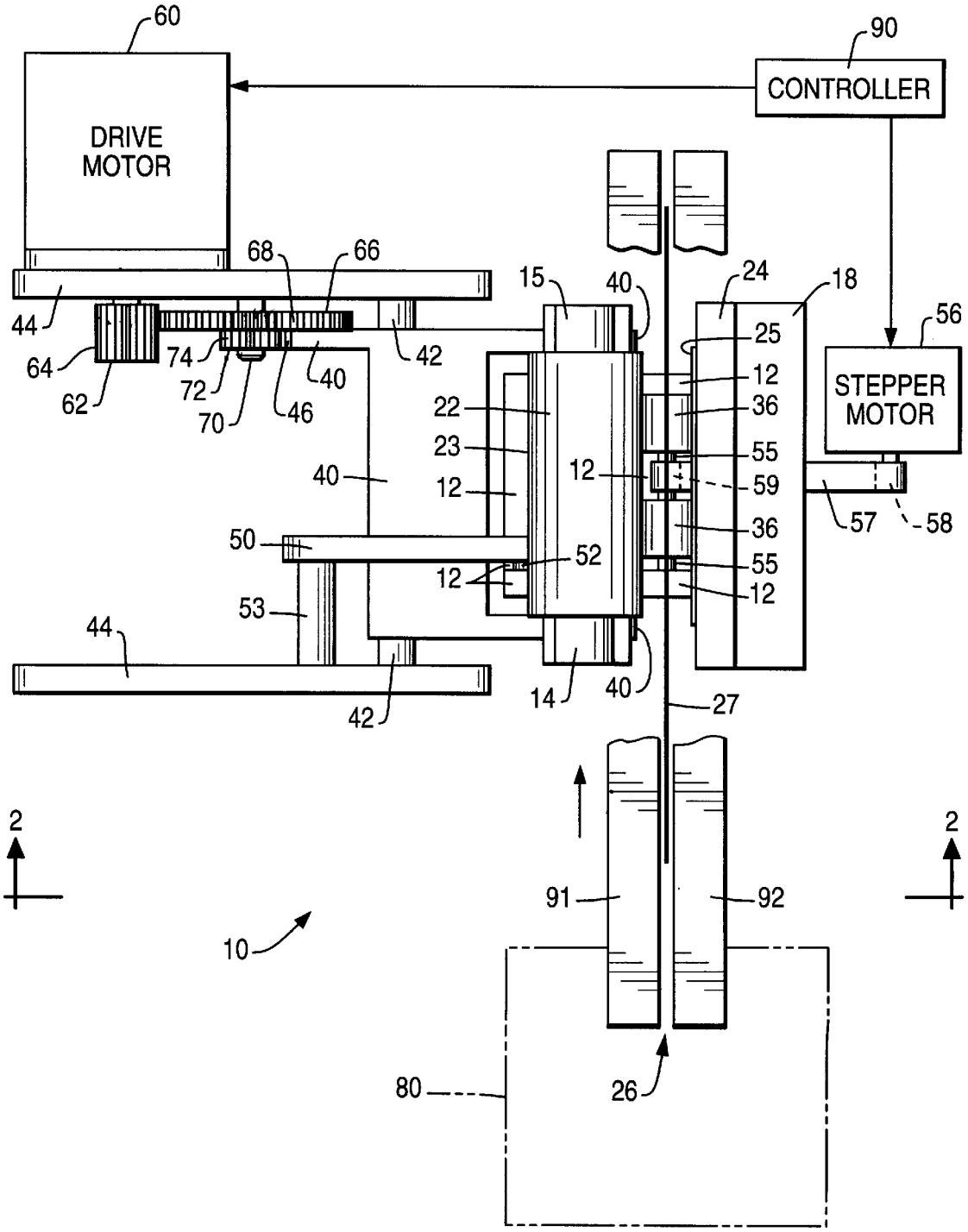
FIG. 1 is a top view of a thermal printer apparatus constructed in accordance with the present invention.
Figure 2:
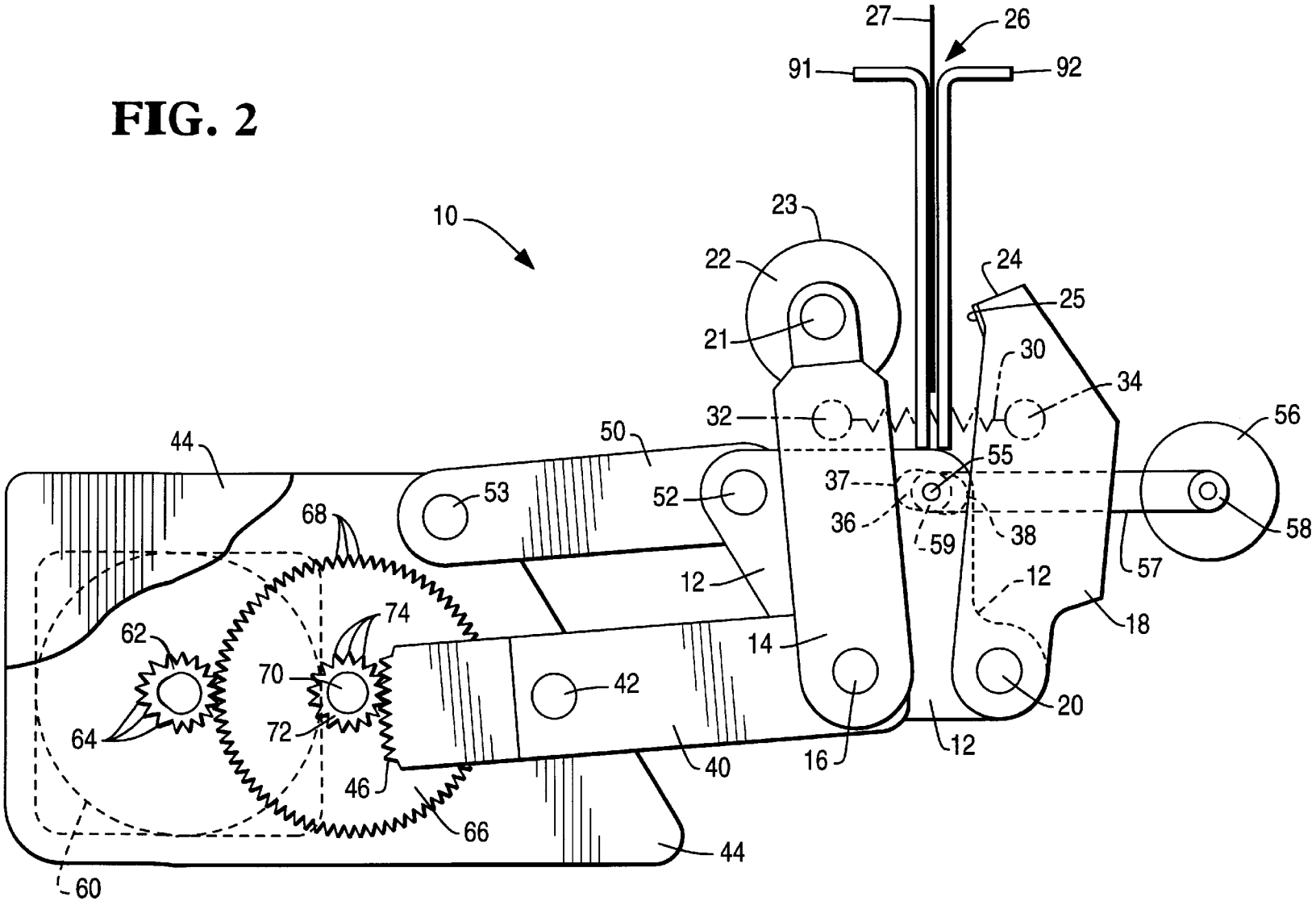
FIG. 2 is a view looking in the direction of line 2—2 in FIG. 1 and showing a thermal print head and a print platen in initial positions.

The present invention is directed to a thermal printer apparatus 10 which is embodied in a thermal printer, as shown in FIGS. 1 and 2. The thermal printer apparatus 10 includes a movable L-shaped platform 12. One end of a first link 40 is pivotably mounted about a pivot 16 which is attached to the platform 12. The other end of the first link 40 is pivotably mounted about a pivot 42 which is attached to a frame part 44. A set of gear teeth 46 is disposed at a far end edge of the first link 40, as shown in FIG. 2.

One end of a first arm 14 is also pivotably connected about the pivot 16. Another arm 15 which is similar to the first arm 14 is pivotably connected about another pivot (not shown) which is attached to the first link 40. One end of a second arm 18 is pivotably connected about a pivot 20 which is also attached to the platform 12. One leg of the L-shaped platform 12 lies in the plane of FIG. 1 and the other leg of the L-shaped platform 12 lies in the plane of FIG. 2. The leg of the L-shaped platform 12 lying in the plane of FIG. 2 has a general shape of a parallelogram, as viewed looking at FIG. 2.

A print platen 22 having an outer circumferential surface 23 is rotatably mounted about a pivot 21 which is disposed at the other end of the first arm 14. A thermal print head 24 having a number of thermal elements 25 is mounted in a known manner at the other end of the second arm 18. The structure and operation of the thermal print head 24 and the thermal elements 25 are well known and, therefore, will not be described. The leg of the L-shaped platform 12 lying in the plane of FIG. 1 has a general shape of a rectangle and extends under the print platen 22 and the thermal print head 24, as viewed looking at FIG. 1.

A pair of brackets 91, 92 define a sheet feed path 26 between the outer circumferential surface 23 of the print platen 22 and the thermal elements 25 of the print head 24. The sheet feed path 26 extends in a direction into the page (as viewed looking at FIG. 2). A thermal print ribbon (not shown) is guided along portions of the print head 24 in a known manner so that information can be printed onto a sheet 27 which has been positioned in a printing position, such as shown in FIG. 2, along the sheet feed path 26 between the outer circumferential surface 23 of the printer platen 22 and the thermal elements 25 of the print head 24.

One end of a load spring 30 is attached to a stud 32 mounted on the first arm 14. The other end of the load spring 30 is attached to a stud 34 mounted on the second arm 18. The spring force of the load spring 30 biases the print platen 22 and the print head 24 towards each other. A pair of cams 36 each having opposite facing cam surfaces 37, 38 is located between the first and second arms 14, 18, as shown in FIG. 2. The cams 36 are rotatably mounted on a cam shaft 55 which is fixedly attached at one end thereof to the platform 12. When the cam surfaces 37, 38 are in their positions shown in FIG. 2, the print platen 22 and the print head 24 are moved apart from each other.

Figure 3:
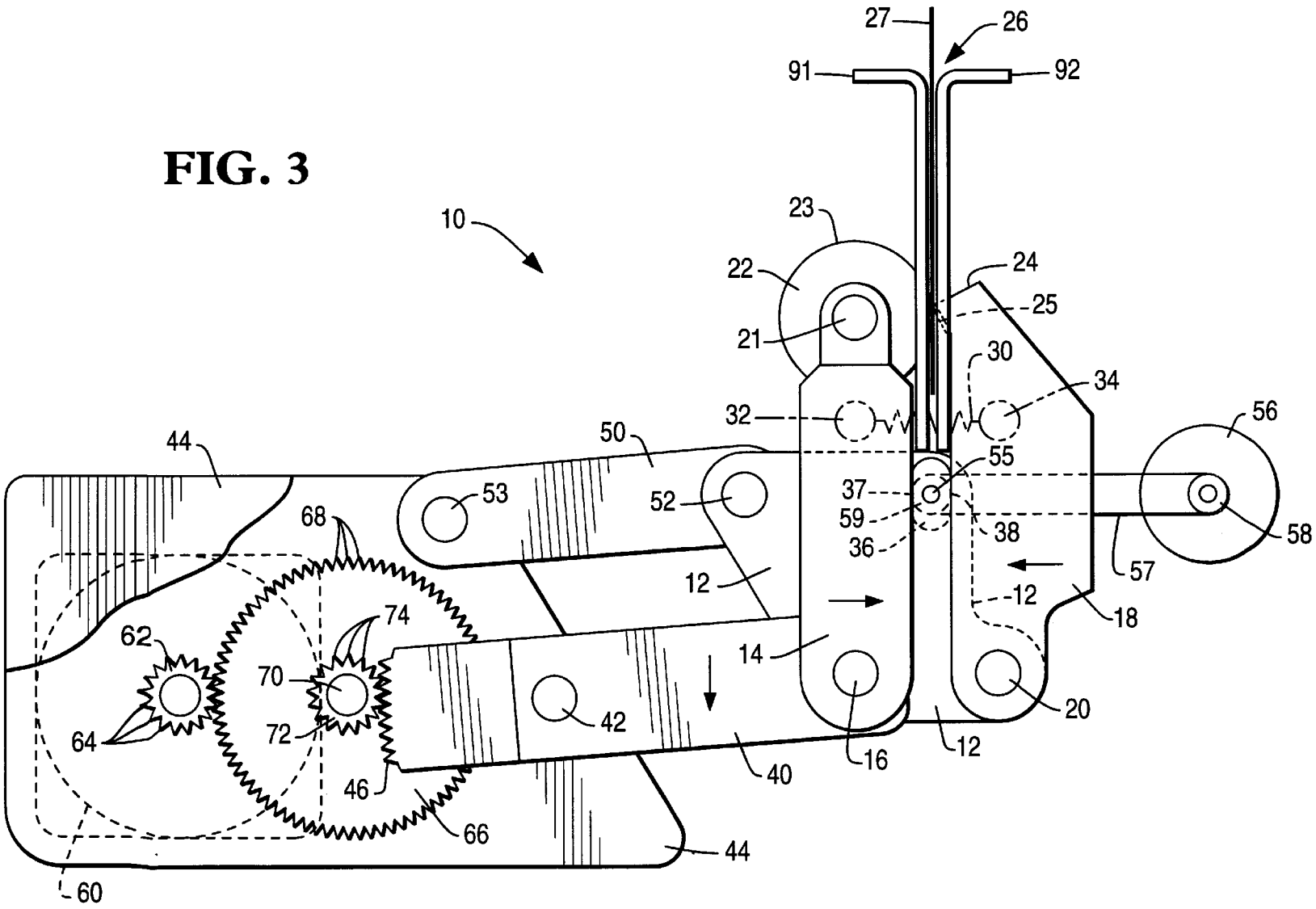
FIG. 3–5 are views similar to FIG. 2 and showing parts in different positions.

An actuatable stepper motor 56 is operatively coupled to the cam 36 in a known manner. More specifically, a drive belt 57 is drivingly connected between a pulley 58 disposed on the output shaft of the stepper motor 56 and a pulley 59 disposed on the cam shaft 55. When the stepper motor 56 is unactuated, the cams 36 and their cam surfaces 37, 38 are in their positions as shown in FIG. 2. When the stepper motor 56 is actuated, the cams 36 and their cam surfaces 37, 38 are in their positions as shown in FIG. 3. A controller 90 controls operation of the stepper motor 56.

One end of a second link 50 is pivotably mounted about a pivot 52 which is attached to the platform 12. The other end of the second link 50 is pivotably mounted about a pivot 53 which is attached to the frame part 44. The first link 40 and the second link 50 extend generally parallel to each other along their longitudinal extents.

An energizeable drive motor 60 is mounted to the frame part 44, as best shown in FIG. 1. The controller 90 controls energization of the drive motor 60. The drive motor 60 has an output shaft to which a first gear 62 having a set of gear teeth 64 is attached.

A second gear 66 has a set of gear teeth 68 which meshingly engages with the set of gear teeth 64 of the first gear 62. The second gear 66 is rotatably mounted about a pivot 70 which is attached to the frame part 44. A third gear 72 has a set of gear teeth 74 which meshingly engages with the set of gear teeth 46 disposed at the far end edge of the first link 40. The third gear 72 is rotatably mounted about the pivot 70, and moves together with the second gear 66 as a unit. The second gear 66 and the third gear 72 act as a reduction gear mechanism for the first gear 62. Preferably, the reduction gear mechanism provides a 20:1 reduction. The size of the steps of the stepper motor 56 could be selected to match the size of a pixel associated with the print head 24.

Figure 5:
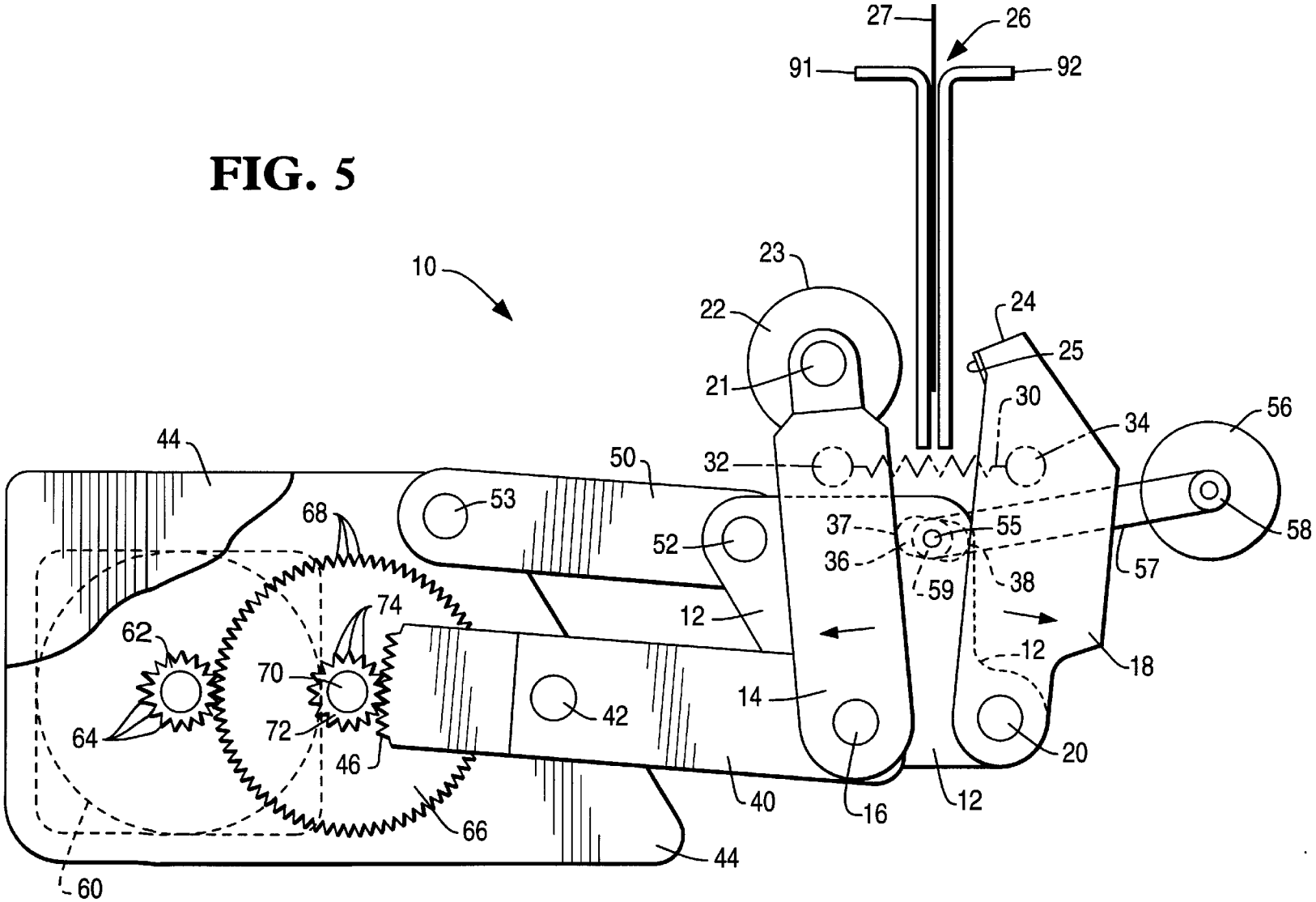

When the drive motor 60 is energized to rotate its output shaft and the first gear 62 in the clockwise direction (as viewed looking in the direction of FIG. 2), the second gear 66 and the third gear 72 rotate in the counterclockwise direction which, in turn, results in vertical downward movement of the platform 12 from the position shown in FIG. 2 to the position shown in FIG. 5. Energization of the drive motor 60 is controlled such that the extent of travel of the platform 12 in the vertical downward direction is limited to that shown in FIG. 5. Accordingly, the print platen 22 and the print head 24 move from their positions shown in FIG. 2 to their positions shown in FIG. 5. When the drive motor 60 is energized to rotate the first gear 62 in the counterclockwise direction, the second gear 66 and third gear 72 rotate in the clockwise direction which, in turn, results in vertical upward movement of the print platen 22 and the print head 24 from their positions shown in FIG. 5 to their positions shown in FIG. 2. Energization of the drive motor 60 is controlled such that the extent of travel of the platform 12 in the vertical upward direction is limited to that shown in FIG. 2.

During a printing operation, the stepper motor 56 is controlled such that the print platen 22 and the print head 24 move towards or away from each other and the drive motor 60 is controlled such that the platform 12 on which the print platen 22 and the print head 24 are mounted is moved vertically upwards or vertically downwards. Initially, the print platen 22 and the print head 24 are in positions shown in FIG. 2. At this time, a sheet feeder 80 (FIG. 1) moves the sheet 27 to be printed on along the sheet feed path 26 to the printing position, as shown in FIG. 2, between the outer circumferential surface 23 of the print platen 22 and the thermal elements 25 of the print head 24.

After the sheet 27 moves to the printing position, the stepper motor 56 is actuated to allow the print platen 22 and the print head 24 to move towards each other under the biasing force of the spring 30 from their positions shown in FIG. 2 to their positions shown in FIG. 3. The drive motor 60 is then energized to move the print platen 22 and the print head 24 vertically downwards from their positions shown in FIG. 3 to their positions shown in FIG. 4. As the print platen 22 and the print head 24 move vertically downwards from their positions shown in FIG. 3 to their positions shown in FIG. 4, the thermal elements 25 of the print head 24 are controlled to print information onto the sheet 27. The print platen 22 is operatively coupled to a one-way clutch (not shown) which allows the print platen 22 to track in only the vertically downward direction.

Figure 4:
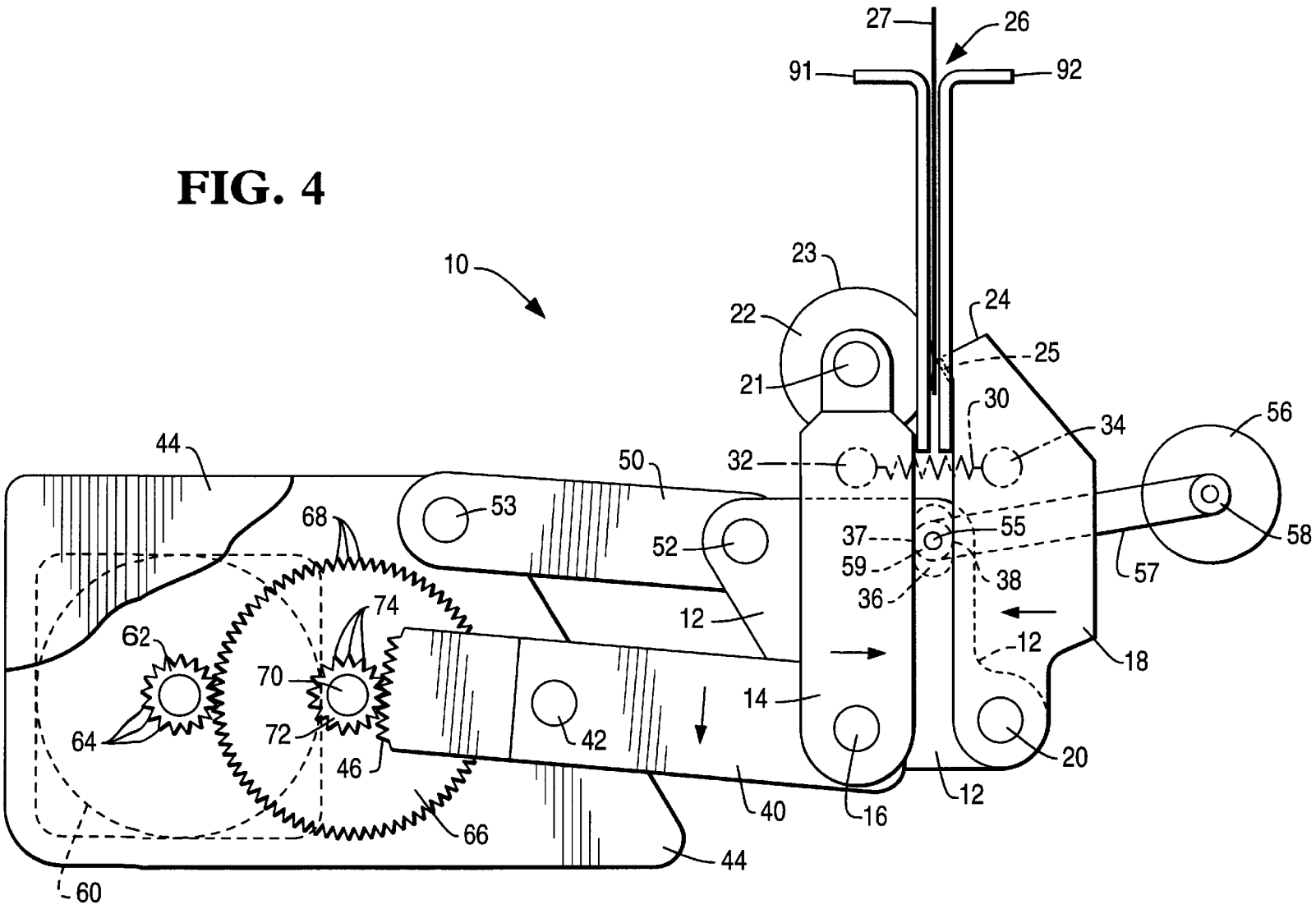

After the above-described printing operation is completed, the stepper motor 56 is again actuated such that the print platen 22 and the print head 24 move away from each other from their positions shown in FIG. 4 to their positions shown in FIG. 5. The drive motor 60 is then energized to move the print platen 22 and the print head 24 vertically upwards from their positions shown in FIG. 5 back to their initial positions shown in FIG. 2. The print platen 22 and the print head 24 are now back in their initial positions awaiting the next printing operation to take place.

A number of advantages result by providing thermal printer apparatus 10 including the cam mechanism which moves the print platen 22 and the print head 24 towards and away from each other and the drive mechanism which moves the print platen 22 and the print head 24 in the vertically downwards and vertically upwards directions. One advantage is increased throughput of sheets moving along the sheet transport path 26. Throughput is increased since the home position of the print head 24 can be vertically adjusted to a position which is close to start of the printing. This minimizes wasted motion of the print head 24 during printing of information onto a sheet which is in the printing position. Another advantage is improved consistency of print quality of the information printed onto sheets moving along the sheet transport path 26. Consistency of print quality is improved since the clamping action on a sheet in the printing position between the print platen 22 and the print head 24 occurs in the central portion of the sheet transport path 26. This minimizes distortion during printing of information onto the sheet which is in the printing position.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A thermal printer apparatus comprising:

a sheet feeder for transporting a sheet to a printing position along a sheet feed path extending along a first direction;

a thermal print head located on one side of the sheet in the printing position;

a print platen located on an opposite side of the sheet in the printing position; and moving means for (i) moving the head and the platen from initial positions towards each other to contact the sides of the sheet in the printing position to allow printing on the sheet in the printing position, (ii) moving the head and the platen in a second direction which is transverse to the first direction to allow printing on the sheet in the printing position to occur while the head and the platen are contacting the sheet in the printing position, (iii) moving the head and the platen away from each other to move the head and the platen out of contact with the sides of the sheet in the printing position after printing on the sheet in the printing position has occurred, and (iv) moving the head and the platen back to their initial positions when the head and the platen are moved away from each other and out of contact with the sides of the sheet in the printing position to allow another printing to occur.

2. A thermal printer apparatus comprising:

means defining a sheet feed path along which a sheet to be printed on can be transported to a printing position, the sheet feed path extending along a first direction;

a thermal print head located on one side of the sheet feed path and for printing onto a sheet which has been transported to the printing position along the sheet feed path;

a print platen located on an opposite side of the sheet feed path and for printing onto a sheet which has been transported to the printing position along the sheet feed path;

a spring mechanism for biasing the head and the platen towards each other to contact the sides of a sheet in the printing position to allow printing on the sheet in the printing position;

a drive mechanism for moving the head and the platen in a second direction which is transverse to the first direction to allow printing on a sheet in the printing position to occur while the head and the platen are contacting the sheet in the printing position; and a cam mechanism for moving the head and the platen away from each other to move the head and the platen out of contact with a sheet in the printing position after printing on the sheet in the printing position has occurred;

the drive mechanism and the cam mechanism cooperating to move the head and the platen back to their initial positions when the head and the platen are moved away from each other and out of contact with a sheet in the printing position to allow another printing to occur.

3. A thermal printer apparatus comprising:

a sheet feeder for transporting a sheet to a printing position along a sheet feed path extending along a first direction;

a thermal print head located on one side of the sheet in the printing position;

a print platen located on an opposite side of the sheet in the printing position; and moving means for (i) moving the head and the platen from initial positions towards each other to contact the sides of the sheet in the printing position to allow printing on the sheet in the printing position, (ii) moving the head and the platen in a second direction which is transverse to the first direction to allow printing on the sheet in the printing position to occur while the head and the platen are contacting the sheet in the printing position, (iii) moving the head and the platen away from each other to move the head and the platen out of contact with the sides of the sheet in the printing position after printing on the sheet in the printing position has occurred, and (iv) moving the head and the platen back to their initial positions when the head and the platen are moved away from each other and out of contact with the sides of the sheet in the printing position to allow another printing to occur;

the moving means including (i) a first arm to which the head is connected, (ii) a second arm to which the platen is connected, and (iii) a spring mechanism interconnecting the first and second arms and biasing the first and second arms towards each other and thereby biasing the head and the platen towards each other.

4. A thermal printer apparatus according to claim 3, wherein the moving means includes a cam positioned between the first and second arms, the cam having cam surfaces which spread the first and second arms apart against the biasing force of the spring mechanism when the cam surfaces are in a predetermined position.

* * * * *